US009534477B2

(12) United States Patent
Keller

(10) Patent No.: US 9,534,477 B2
(45) Date of Patent: Jan. 3, 2017

(54) METHOD OF INSTALLATION OF FLEXIBLE BOREHOLE LINER UNDER ARTESIAN CONDITIONS

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 351 days.

(21) Appl. No.: 14/205,480

(22) Filed: Mar. 12, 2014

(65) Prior Publication Data

US 2014/0262346 A1 Sep. 18, 2014

Related U.S. Application Data

(60) Provisional application No. 61/783,281, filed on Mar. 14, 2013, provisional application No. 61/853,096, filed on Mar. 28, 2013.

(51) Int. Cl.
*E21B 43/10* (2006.01)

(52) U.S. Cl.
CPC ..... *E21B 43/103* (2013.01)

(58) Field of Classification Search
USPC ..... 166/384, 67
See application file for complete search history.

(56) References Cited

U.S. PATENT DOCUMENTS 4,778,553 A 10/1988 Wood
5,176,207 A 1/1993 Keller
5,246,862 A 9/1993 Grey et al.
5,377,754 A 1/1995 Keller
5,803,666 A 9/1998 Keller
5,804,743 A 9/1998 Vroblesky et al.
5,853,049 A 12/1998 Keller
6,026,900 A 2/2000 Keller
6,109,828 A 8/2000 Keller
6,244,846 B1 6/2001 Keller
6,283,209 B1 9/2001 Keller
6,910,374 B2 6/2005 Keller
7,281,422 B2 10/2007 Keller
7,753,120 B2 7/2010 Keller
7,841,405 B2 11/2010 Keller
7,896,578 B2 3/2011 Keller
8,069,715 B2 12/2011 Keller
8,176,977 B2 5/2012 Keller
8,424,377 B2 4/2013 Keller
2007/0260439 A1* 11/2007 Keller ..... E21B 49/08 703/10

(Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.

(Continued)

*Primary Examiner* — Taras P Bemko
(74) *Attorney, Agent, or Firm* — Rod D. Baker

(57) ABSTRACT

An apparatus and method for facilitating eversion of a flexible liner down a borehole when an artesian head condition is producing a rate of water flow out of the top of the borehole. A bypass pipe channels artesian flow, moving upward in the borehole and/or well casing, past an everting flexible liner to a wellhead fixture. Artesian flow arriving at the wellhead fixture is pumped away to ameliorate resistance to liner eversion otherwise presented by the water flow. A heavy mud may be disposed inside the everting liner further to promote its downward eversion past the artesian flow.

20 Claims, 6 Drawing Sheets

(56) References Cited

U.S. PATENT DOCUMENTS

2010/0263859 A1* 10/2010 Kriesels ..... E21B 7/20
166/207
2012/0173148 A1 7/2012 Keller

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner

METHOD OF INSTALLATION OF FLEXIBLE BOREHOLE LINER UNDER ARTESIAN CONDITIONS

CROSS-REFERENCE TO RELATED APPLICATIONS

This application claims the benefit of the filing of U.S. Provisional Patent Application Ser. No. 61/783,281 titled "Method of Installation of Flexible Borehole Liner Under Artesian Conditions" filed on 14 Mar. 2013, and of the filing of U.S. Provisional Patent App. Ser. No. 61/853,096 titled "Method of Installation of Flexible Borehole Liner Under Artesian Conditions" filed on 28 Mar. 2013, both the specifications of which are incorporated herein by reference. This application is related to U.S. Provisional Patent App. Ser. No. 61/793,548 entitled "Method for Sealing of a Borehole Liner in an Artesian Well" filed on 15 Mar. 2013, and the specification thereof also is incorporated herein by reference.

BACKGROUND OF THE INVENTION

Field of the Invention

This invention relates to the installation of everting flexible borehole liners into boreholes in geologic formations with shallow water tables or in geologic formations exhibiting artesian hydraulic head conditions.

Background

A "borehole" is a hole, e.g., a shaft or well, drilled into the Earth's subsurface. The hydraulic conductivity profiling techniques described in U.S. Pat. No. 6,910,374 and U.S. Pat. No. 7,281,422 have been used in over 400 boreholes since 2007. These patents, whose complete teachings are incorporated herein by reference, describe methods for determining the hydraulic transmissivity profile of the geologic formations surrounding borehole by carefully measuring the eversion of a flexible borehole liner into an open, stable, borehole. Other installations of flexible liners into boreholes, by the eversion of the liners, are disclosed in a number of other patents, such as U.S. Pat. Nos. 6,283,209, 6,794,127, and 7,896,578, obtained by this inventor. Such liners are usually installed into the open boreholes using a water level inside the liner which is significantly higher than the water table in the formation penetrated by the borehole.

However, when that required excess pressure head (difference between ambient water table level and water level supplied to the liner interior) is not available at a particular borehole, a scaffold plus an extension of the surface casing may be used to achieve the needed higher water level within the liner. In some situations of very shallow water tables, or in situations where the head within the borehole would rise above the ground surface if the surface casing were extended above the surface, the required scaffold is so high as to be very inconvenient or even dangerous, and use of scaffolds often exposes the installation personnel to freezing winter winds.

With the foregoing background, the presently disclosed invention was developed.

SUMMARY OF THE INVENTION

The invention described hereafter allows the transmissivity profiling procedure, and the installation of flexible liners used for other measurements or purposes, to be accomplished without the need for extensive scaffolding above the borehole. Furthermore, the presently disclosed apparatus and method allow the liner installation when the artesian head condition in the borehole is producing a very high rate of water flow out of the top of the borehole. Using previously known techniques, the installation of everting flexible liners into boreholes was limited to situations of less than approximately five feet of artesian head above the ground surface, even when scaffolding was employed. In contrast, the present invention greatly extends the circumstances of successful use of everting flexible liners, even to situations involving natural artesian heads twenty feet above the ground's surface. Furthermore, the method of the present disclosure allows easier installations under the more commonly encountered conditions of shallow water tables. Additional benefits will be described hereafter.

There is disclosed hereby a method and apparatus to reduce the effective water table beneath an everting flexible borehole liner, and to provide a higher pressure within the liner, in order to allow the liner eversion into the borehole, despite the existence of high artesian pressures. The method is accomplished without the extension of the borehole surface casing far above the surface to obtain the necessary driving pressure within the liner. An advantage of the presently disclosed method is that it allows the normal artesian flow out of the borehole to bypass the liner during its installation, thereby preventing the normal development of a high water pressure beneath the liner (i.e., between the descending eversion point of the liner and the bottom of the borehole). A further advantage is that in those boreholes which produce a natural gas flow to the surface, the gas is not trapped beneath the everting liner, which trapped gas hinders everting liner propagation down the borehole.

BRIEF DESCRIPTION OF THE VARIOUS VIEWS OF THE DRAWING

The attached drawings, which form part of this disclosure, are as follows.

DETAILED DESCRIPTION OF THE INVENTION

Figure 1:
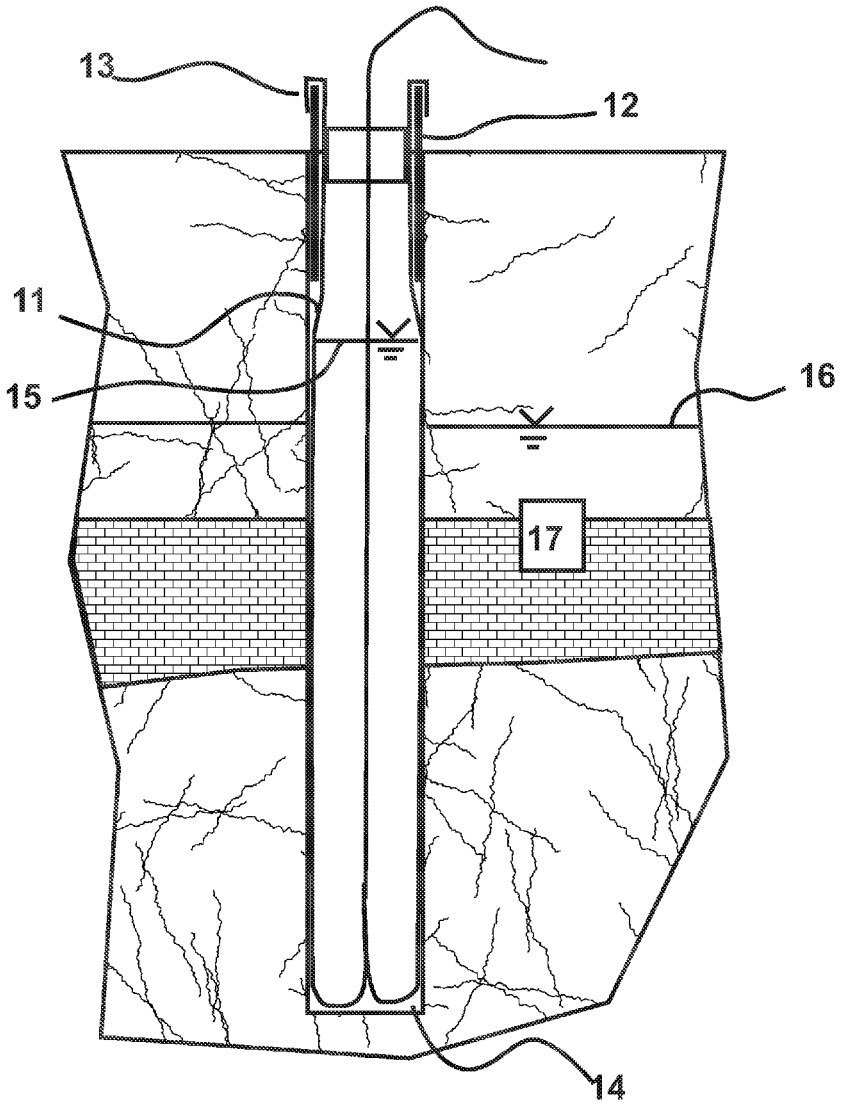
FIG. 1 is a side sectional view of a typical everting liner installation according to known techniques.

An everting liner installation according to known techniques is shown in FIG. 1. The liner 11 has been attached to the top of the casing 12 at location 13. The liner in the borehole 14 is filled to the level 15, which is above the water table 16 in the formation 17. The water within the borehole 14 beneath the liner (i.e., between the bottom of the liner and the bottom of the borehole) is displaced into available flow paths in the formation 17 allowing the liner 11 to propagate by eversion of the liner at the bottom everting end of the liner. The driving pressure to evert the liner 11 is due to the difference between the head at the water level 15 in the liner and the head at the water table 16 in the formation 17.

If the pressure head at the level 16 in the formation 17 is higher than the head at level 15 inside the liner 11, the liner will be collapsed by the formation water pressure, and the liner cannot propagate down the borehole. A minimum pressure difference, between level 15 and level 16, is needed to cause the liner to propagate in the eversion process. That minimum eversion pressure is greater for smaller borehole diameters than for larger diameter boreholes. For the liner 11 to be easily everted down the borehole, the water table 16 in the open borehole must be a sufficient distance below the top of the surface casing 12 to allow a water fill of the liner to drive the eversion process. For some boreholes, the minimum water table depth in the formation 17 must be at least five feet below the top of the casing 12. In other situations of smaller boreholes, a water table 16 of at least twenty feet below the top 13 of the casing 12 may be required to supply an adequate liner driving pressure. If the water table 16 in the formation is less than the necessary depth distance below the top 13 of the casing 12, the above-ground height of the casing 12 can be extended upward to obtain a higher water level 15 inside the liner 11. However, there are practical safety limits as to how high the casing can be extended, with the associated surrounding scaffolding, and still allow safe working space for the installation personnel. In some situations, for safety reasons there are prohibitions against the use of any scaffolding.

Figure 2:
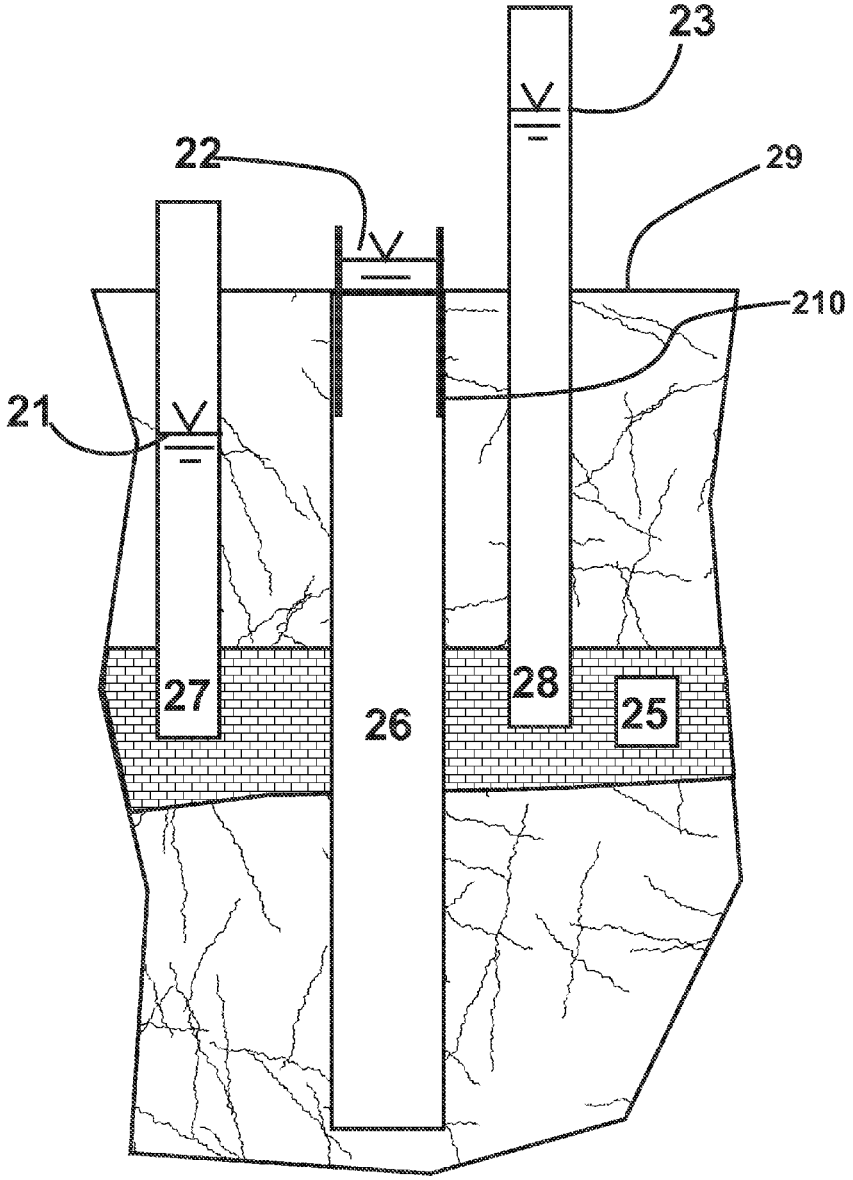
FIG. 2 is a side sectional view of three examples of water table conditions of increasing difficulties addressed according to the present invention.

FIG. 2 illustrates several static water tables as may be seen in three hypothetical boreholes 26, 27, 28 extending into a geologic formation 25. In a commonly encountered circumstance, the water table level 21 is in the borehole 27 a considerable (e.g., more than about ten to fifteen feet) below the surface 29. A more troublesome situation is when the natural water level 22 is near the surface 29 (below the top end of a casing 210), as seen in the middle borehole 26 of FIG. 2. The degree of difficulty in pressure-everting a liner into such a borehole will depend somewhat upon the diameter of the borehole; generally, such a troublesome "shallow condition" involves a natural water table less than about five to about ten feet below the top end of the well casing. The more difficult situation for installing everting liners, seen in the borehole 28 on the right side of FIG. 2, is when the level 23 of the water table in the formation intersected by the borehole 28 is above the top of the well casing, perhaps many feet above, and thus substantially above the ground's surface 29. This is an artisan condition; in this disclosure, "artesian flow conditions" refers to the spontaneous (without artificial pumping), upward movement of water, under hydrostatic pressure in rocks or unconsolidated material beneath the earth's surface, to an elevation above the earth's surface. In this latter case, if the height of the casing were below the level 23, the water from the subsurface formation(s) 25 would flow over the top of the surface casing (i.e., 210 in the figure) onto the surface of the ground. If the natural level 23 is very high above the surface 29, and the transmissivity of the formation 25 is a large value, the flow rate out of the top of the (too-short) casing 210 would be large. Such flows, which can exceed 100 gal/min, normally are extremely undesirable at the borehole installation site.

In the borehole 27 seen at the left side of FIG. 2, where the natural water level 21 is a significant distance below the surface of the ground, a typical liner installation can be effected by known techniques, as indicated in FIG. 1. In the circumstance of the middle borehole 26 in FIG. 2, with the water level 22 near the surface 29, a casing extension is needed. In the third situation seen in the right borehole 28 of FIG. 2, an everting liner installation normally would not be attempted. Whereas this invention is most useful in allowing a liner to be installed at a borehole, such as borehole 28 with an elevated artesian water level 23 see in FIG. 2, the invention also facilitates installation in the situation of a borehole 26 with a natural water level 22 modestly above the ground's surface 29 without scaffolding or a casing extension; the method and apparatus thus is an improvement beyond currently known practices, due to safety concerns about tall scaffolding and the inconvenience of personnel working on scaffolding.

This disclosure is not a contention that it has not previously been known to use a heavy mud, in lieu of water, to pressurize and install by eversion a flexible borehole liner. Rather, the present apparatus and method are an innovative combination of processes for allowing the installation of everting liners under challenging conditions such as water levels 23 elevated many feet above the ground surface 29 such as generally described in reference to borehole 28 in FIG. 2. Such circumstances, called artesian head conditions, normally prohibit the safe installation of everting flexible liners. Some key features of the present apparatus are the bypass pipe, the mud fill, the bulbous wellhead fixture, and the wellhead pump, all as described hereafter.

Figure 3:
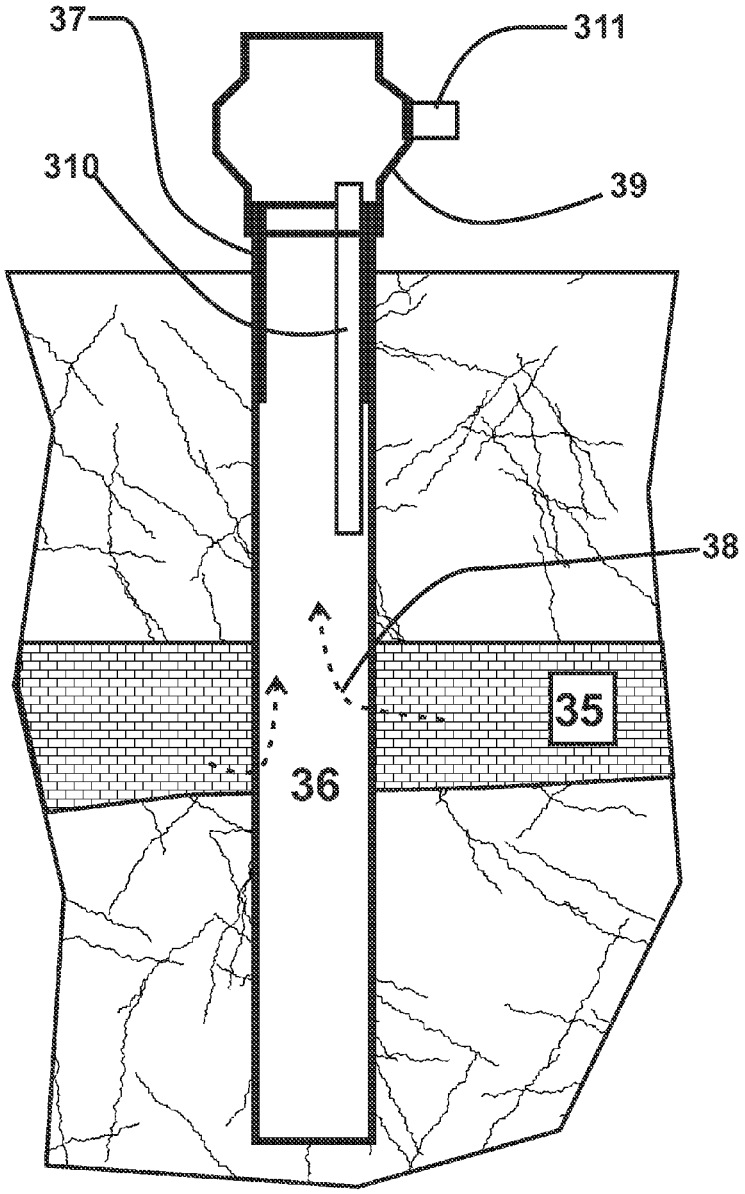
FIG. 3 is a side sectional diagrammatic view of a borehole, showing the location of a bypass pipe and wellhead fixture according to the present invention, to allow the water table in the hole to be lowered and the artesian flow to be directed past the everting liner.

FIG. 3 shows a borehole 36 in fractured rock formation 35 with a surface casing 37 extending some depth into the fractured rock. FIG. 3 shows a partial system according to this disclosure, prior to initial completed installation. The artesian condition is shown as an upward flow 38 (directional arrows) allowing water flow over the top of the surface casing 37 above the ground's surface. A hollow wellhead fixture 39 is attached to the top of the casing 37 to support an everting liner (described further hereinafter). The fixture 39 preferably is "bulbous," meaning that it is roughly spherical in shape to enclose an interior space, and in horizontal size (i.e. horizontal dimension or diameter) is substantially larger than the diameter of the casing 37. The larger bulbous shape of the fixture 39 provides some working space within the fixture interior (e.g., for placing and arranging a liner preparatory to liner eversion), and the provision of a discharge outlet 311 in and on the fixture. A bypass pipe 310 of sufficient diameter to accommodate the entire artesian flow 38 is lowered into position in the borehole 36, and situated proximate to and extending up above the top of the surface casing 37 as seen in FIG. 3. Preferably installed, the bypass pipe 310 is intermediately overlapping between the casing 37 and an interior of the fixture 39, with an open bottom end of the bypass pipe extending a distance into the borehole and an open top end of the bypass pipe extending into the interior of the fixture. As a result, any water flowing upward in the borehole toward the casing 37 can flow upward through the bypass pipe 310 and into the interior of the fixture 39.

The bypass pipe 310 may be lowered, supported, and adjustably positioned with a suitable cable or other device (not shown), which supports the upper open end of the bypass pipe near a discharge outlet 311, which may be about horizontal, on and for the bulbous wellhead fixture 39. The vertical elevation of the bypass pipe 310 may be adjustable relative to the casing 37 and/or fixture 39, as with a retractable cable extending from the top of the bypass pipe to a winch (not shown) at or near the fixture 39. The bypass pipe 310 can be any conduit or tube suitable for transmitting a liquid flow, and preferably is rigid against radial collapse. As suggested by the figures, the axis of the bypass pipe 310 preferably is oriented substantially vertically, and the pipe is placed in close adjacency with, or in contact with, the casing 37.

Figure 4:
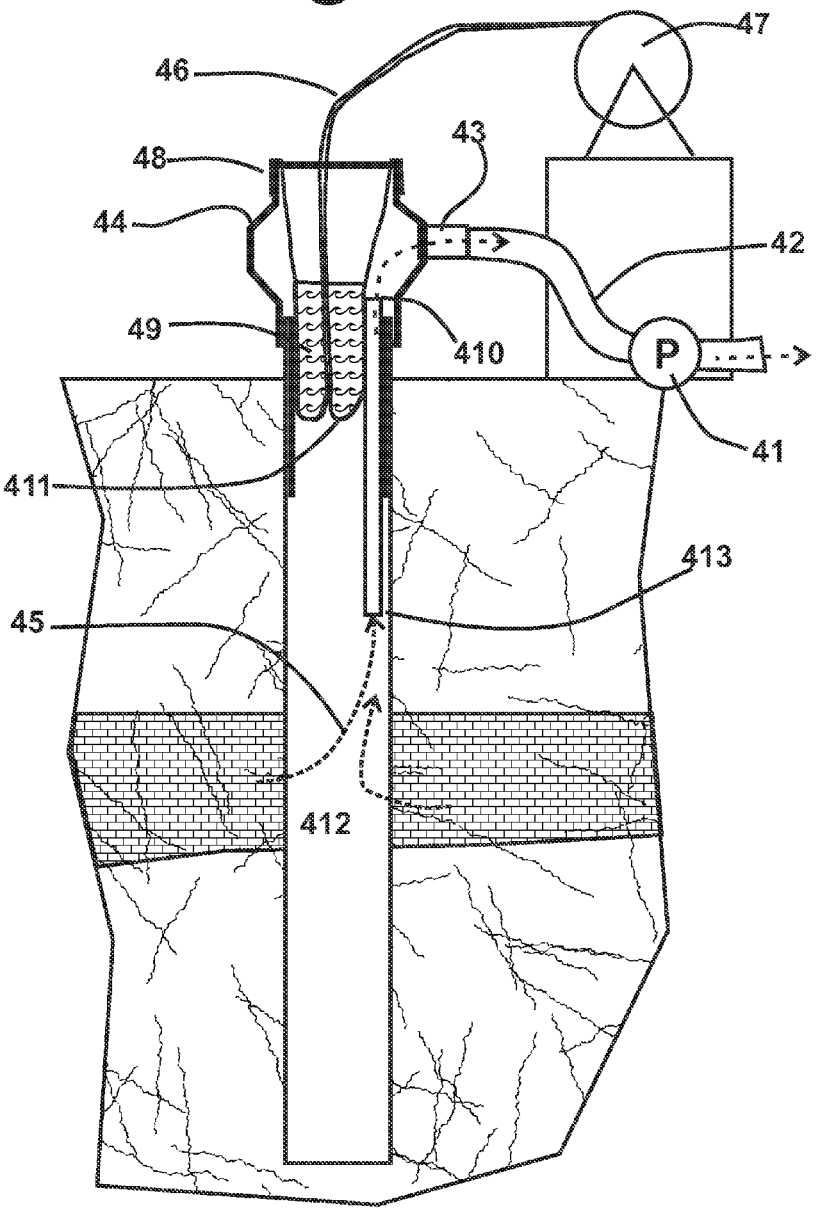
FIG. 4 is a side sectional diagrammatic view of a borehole similar to FIG. 3, showing the addition of a weighty but flowable mud to the interior of the liner and the presence of selected components of the apparatus system according to the present invention.

Referring to FIG. 4, which shows the initial stages of installation, a pump 41 is connected with a hose 42 to be in fluid communication with the discharge outlet 43 (corresponding to outlet 311 in FIG. 3), of the bulbous wellhead fixture 44 (corresponding to fixture 39 in FIG. 3). The pump 41 has a sufficient discharge rate to draw off the water 45 rising (see directional arrows in well bore in FIGS. 3 and 4) under artesian pressure from the well or borehole 412. The pumping, with the pump 41, of water from the interior of the fixture 44 at a rate at least equaling the flow 45 of water from the borehole 412 via the bypass pipe 413, lowers or reduces the effective water table elevation (e.g., elevation 23 in FIG. 2); this pumping and effective reduction in the natural water table elevation promotes the eversion of a liner into a borehole under artesian conditions, so as to allow a mud-filled liner 46 to descend to the open bottom of a bypass pipe 413.

Figure 5:
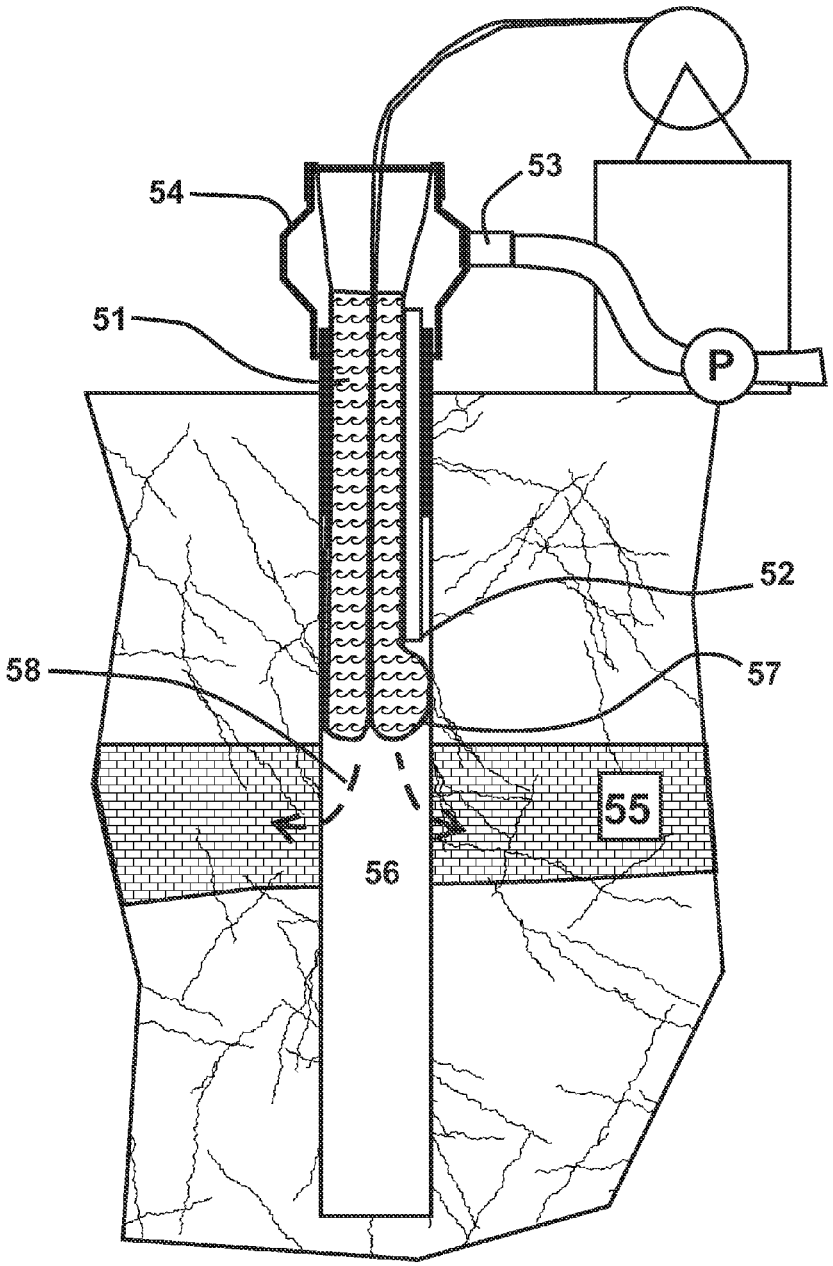
FIG. 5 is a view similar to that seen in FIG. 4, showing the extension of the mud-filled liner past the bypass pipe.

A flexible liner 46 is wound upon a reel 47 next to the wellhead on a short platform. The liner 46 is inside-out on the reel 47 as described in U.S. Pat. No. 7,281,422 and as shown in FIG. 1 herein. In FIG. 4, the pump 41 is actuated to draw the water level in the bulbous wellhead fixture 44 to the level of the outlet 43. An open-ended bypass pipe 413 is provided proximate to the borehole's surface casing (as also described in reference to FIG. 3). The open end of the liner 46 is then slipped over the bulbous wellhead fixture at upper location 48 and secured tightly with, e.g., a hose clamp (not shown) to the top of the wellhead fixture 44. The liner 46 is then pushed into the wellhead fixture 44 a short distance (e.g., about arms length, approximately two to three feet) to form an annular pocket 49 as seen in FIG. 4. A heavy water-based mud mixture such as may be confected of bentonite and powdered barite is then added, as by pouring into the annular pocket 49, causing the liner 46 to evert past the open top end of the bypass pipe 413. For purposes of this disclosure, the mud mixture preferably has a weight of between about 9.0 lbs/gal and about 15 lbs/gal, although these are by way of example; mud density may be customized to the conditions of the well. As indicated in FIGS. 4 and 5, the bypass pipe preferably is between the liner and the casing, or between the liner and the wall of the borehole, as the liner descends toward the bottom of the borehole.

As indicated in FIGS. 3 and 4, the open top end of the bypass pipe 310, 413 preferably extends above the top of the casing and into the hollow interior of the bulbous wellhead fixture 39, 44 that is secured atop the casing. The bypass pipe 413 of FIG. 4 is of sufficient vertical length that the heavy mud column inside the liner 46 will develop a hydrostatic pressure in the lower, everting, end 411 of the liner 46, which pressure exceeds the artesian head in the borehole 412 when the liner 46 has propagated downward in the borehole past the bottom end of the bypass pipe 413.

Prior to the liner everting to the open bottom end of the bypass pipe, however, the upward flow 45 in the borehole 412 is diverted, via the bypass pipe, past the everting liner 46 to the pump extraction outlet 43 in the bulbous fitting 44. The water flowing upward in the well (i.e., flow 45 in FIG. 4) flows up through the bypass pipe, through the interior of the bulbous wellhead fixture 44, and is pumped off (especially if artesian pressure is insufficient) through the outlet 43 by the action of the pump 41. Accordingly, the liner's downward eversion is resisted little, nearly not at all, by the high pressure upward flow in the borehole 412, until the liner 46 has reached the depth of the bottom end of the bypass pipe 413.

As indicated by FIG. 4, the top of the bulbous fixture 44 preferably is open, to allow the disposition of the liner 46 into the fixture interior and the addition of the heavy water-based mud 49 into the liner interior to pressure the liner interior. If desired or necessary in a very fast-flowing artesian well, a short (e.g., 3 feet to about 5 ft) casing extension may be sealably provided upon the open top of the wellhead fixture 44 to extend upward there from, and the free end of the liner attached to the top end of such casing extension, to permit the heavy-mud filled liner 46 to extend above the fixture 44.

FIG. 5 illustrates the system after liner eversion has progressed some distance down the borehole 56. FIG. 5 shows that when the liner 57 filled with mud 51 everts past the lower open end 52 of the bypass pipe (i.e., 413 in FIG. 4), the filled liner 57, under the pressure of the contained mud 51, presses tightly against the borehole wall below the lower end 52 of the bypass pipe. The mud-filled liner 57 thus shuts off the upward flow of water in the bypass pipe, because the mud column pressure (inside the liner 57) is greater than the artesian pressure in the formation 55 of FIG. 5. At that point, the mud column 51 pressure within the liner 57 is greater than the artesian head, and the liner 57 can continue to evert further down the borehole 56 in the usual manner.

Figure 6:
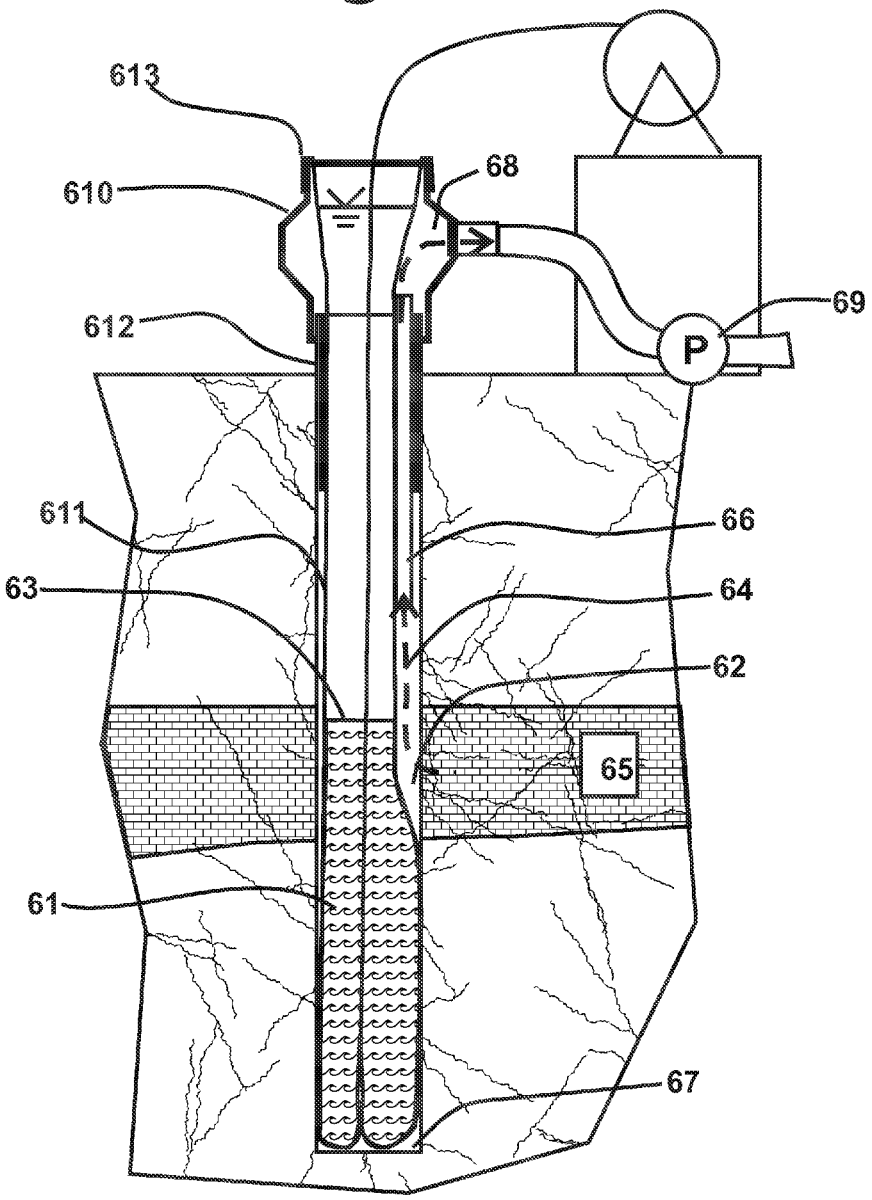
FIG. 6 is a view similar to that seen in FIG. 5, showing the further descent of the liner, with the artesian flow ascending adjacent to the liner and being removed at the wellhead fixture.

FIG. 6 shows that as the portion of the liner 611 that contains the mud 61 everts past the borehole elevation 62 at which the artesian flow enters the borehole, the corresponding artesian pressure originating at the formation 65 tends to collapse that portion of the liner 611 not sufficiently dilated with the heavy mud 61, or without sufficient mud head 63 (FIG. 6) to exceed the artesian pressure at elevation 62. Such a situation as seen in FIG. 6 allows the artesian flow discharge to resume and to flow upward in a space 64 between the borehole wall and liner 611 to the bypass pipe 66 as the liner is everted to the bottom of the hole 67. The above-ground flow 68 (FIG. 6, dashed directional line) travels from the pipe 66 (or adjacent to the pipe) to the elevation of the bulbous wellhead fixture, and then through the fixture interior and exits the fixture outlet. Note that the bulbous wellhead fixture 610 allows water rising anywhere between the upper portion of the liner 611 and the casing 612 to be collected and drawn off by the pump 69. The discharge outlet of the bulbous wellhead fixture 610 allows the pump 69 rapidly to draw off the water that would otherwise tend to collapse the liner 611, because the top end of the liner is sealed to the bulbous fitting 610 at location 613. In this manner, the pump 69 can greatly reduce any tendency of the liner to be collapsed by the artesian flow above the mud-filled portion of the liner in the vicinity of elevation 62. Use of this method and technique, including the operation of the foregoing components, including a bypass pipe 66, a bulbous wellhead fixture 610, a pump 69, and weighted mud fill 61 have allowed everting liners to be installed into boreholes while performing the measurements described in U.S. Pat. No. 7,281,422, and with extreme artesian flow conditions of over 100 gallons/min., and even with artesian heads greater than 20 feet above the surface.

If the liner is a temporary liner it can be inverted from the borehole in the reverse of the procedure described above, except that the pump is still used to reduce the collapse of the liner. If the liner is to be a relatively permanent installation, the liner is filled with a weighted mud or with a grout fill. The grout fill results in an essentially permanent installation and prevents the artesian pressure collapse of the liner. The grout fill involves a special procedure to assure that the liner does not collapse as the grout is curing.

Although the invention has been described in detail with particular reference to these preferred embodiments, other embodiments can achieve the same results. The present inventive method can be practiced by employing generally conventional materials and equipment. Accordingly, the details of such materials and equipment are not set forth herein in detail. In this description, specific details are set forth, such as specific materials, structures, chemicals, processes, etc., in order to provide a thorough understanding of the present invention. However, as one having ordinary skill in the art would recognize, the present invention can be practiced without resorting strictly only to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

I claim:

1. A method for installing a flexible liner by eversion down a borehole, the method comprising:

attaching a hollow fixture atop a casing of a borehole;

situating a bypass pipe between the casing and an interior of the fixture, an open bottom end of the bypass pipe extending a distance into the borehole and an open top end extending into the interior of the fixture, whereby any water flowing upward in the borehole toward the casing can flow upward through the bypass pipe and into the interior of the fixture;

securing a first end of a flexible liner above the casing;

disposing the liner into the fixture;

adding a water-based mud into an interior of the liner to create a liner interior pressure;

everting the liner, by the liner interior pressure, down the borehole, with the bypass pipe outside the liner; and allowing water to flow upward from the borehole from beneath an everting second end of the flexible liner through the bypass pipe and into the interior of the fixture.

2. The method of claim 1 wherein attaching a fixture comprises the step of attaching a fixture having a discharge outlet therein.

3. The method of claim 2, wherein attaching a fixture comprises the step of attaching a fixture that is bulbous relative to the casing.

4. The method of claim 2, further comprising pumping water from within the fixture interior via the outlet.

5. The method of claim 4 further comprising the steps of:

reducing an effective water table elevation of the borehole; and allowing the liner to descend below a bottom open end of the bypass pipe.

6. The method of claim 1 wherein situating a bypass pipe comprises the steps of lowering the bypass pipe and adjusting its vertical elevation.

7. The method of claim 1 wherein situating a bypass pipe comprises the step of placing the bypass pipe in adjacent contact with the casing.

8. The method of claim 1 wherein securing the first end of a flexible liner comprises securing the first end of the flexible liner to the fixture.

9. The method of claim 1 wherein securing the first end of a flexible liner comprises the steps of:

sealably providing a casing extension at an open top of the fixture; and securing the first end of the liner to the casing extension.

10. A system for installing a flexible liner down a borehole, the system comprising:

a hollow fixture atop a casing of the borehole;

a bypass pipe between the casing and an interior of the fixture, an open bottom end of the bypass pipe extending a distance into the borehole and an open top end extending into the interior of the fixture, whereby any water flowing upward in the borehole toward the casing can flow upward through the bypass pipe and into the interior of the fixture;

a flexible liner disposed into the fixture and having a first end secured above the casing; and a water-based mud in an interior of the liner to create a liner interior pressure whereby an everting second end of the liner may be everted down the borehole;

wherein water flowing upward from the borehole flows beneath the everting second end of the flexible liner outside the liner through the bypass pipe and into the interior of the fixture.

11. The system of claim 10 wherein the fixture comprises a discharge outlet therein.

12. The system of claim 11 wherein the fixture is bulbous.

13. The system of claim 11, further comprising a pump, in fluid communication with the discharge outlet, for pumping water from within the fixture interior.

14. The system of claim 10 wherein further comprising means for lowering the bypass pipe and adjusting the vertical elevation of the bypass pipe.

15. The system of claim 10 wherein the bypass pipe is in adjacent contact with the casing.

16. The system of claim 10 wherein the first end of the flexible liner is secured to the fixture.

17. The system of claim 10, further comprising a casing extension sealably connected to an open top of the fixture, and wherein the first end of the liner is secured to the casing extension.

18. A method for installing a flexible liner by eversion down a borehole, the method comprising:

attaching a hollow fixture atop a casing of a borehole, wherein attaching the fixture comprises attaching a fixture having a discharge outlet therein;

situating a bypass pipe between the casing and an interior of the fixture, an open bottom end of the bypass pipe extending a distance into the borehole and an open top end extending into the interior of the fixture, whereby any water flowing upward in the borehole toward the casing can flow upward through the bypass pipe and into the interior of the fixture;

securing an end of a flexible liner above the casing;

disposing the liner into the fixture;

adding a water-based mud into an interior of the liner to create a liner interior pressure;

everting the liner, by the liner interior pressure, down the borehole;

allowing water to flow upward from the borehole through the bypass pipe and into the interior of the fixture;

pumping water from within the fixture interior via the outlet;

reducing an effective water table elevation of the borehole; and allowing the liner to descend below a bottom open end of the bypass pipe.

19. The method of claim 18 wherein situating a bypass pipe comprises the steps of lowering the bypass pipe and adjusting its vertical elevation.

20. The method of claim 18 wherein situating a bypass pipe comprises the step of placing the bypass pipe in adjacent contact with the casing.

* * * * *